United States Patent [19]

Martin

[11] Patent Number: 4,781,167

[45] Date of Patent: Nov. 1, 1988

[54] COMPOUND BOW WITH ADJUSTABLE TENSION CABLE ANCHOR

[75] Inventor: Dan J. Martin, Walla Walla, Wash.

[73] Assignee: Martin Archery, Inc., Walla Walla, Wash.

[21] Appl. No.: 20,753

[22] Filed: Mar. 3, 1987

[51] Int. Cl.[4] ..... F41B 5/00

[52] U.S. Cl. ..... 124/23 R; 124/90; 124/86; 124/DIG. 1; 24/71.1

[58] Field of Search ..... 124/23 R, 24 R, 86, 124/90, DIG. 1; 24/68 R, 68 A, 68 B, 71.1, 115 F, 135 N; 403/41, 210

[56] References Cited

U.S. PATENT DOCUMENTS

| | | | |
|---|---|---|---|
| 1,273,922 | 7/1918 | Prattinger | 24/135 N |
| 1,746,090 | 2/1930 | Rechter | 24/135 N |
| 1,882,167 | 10/1932 | Thirwell | 24/135 N |
| 3,486,495 | 12/1969 | Allen | 124/24 R |
| 3,595,213 | 7/1971 | Storer | 124/23 R |
| 3,967,609 | 7/1976 | Frydenlund | 124/24 R |
| 3,993,039 | 11/1976 | Groves et al. | 124/23 R |
| 4,054,118 | 10/1977 | McKee et al. | 124/23 R |
| 4,061,124 | 12/1977 | Groner | 124/23 R |
| 4,064,862 | 12/1977 | Groner | 124/23 R |
| 4,192,280 | 3/1980 | Rickard | 124/23 R |
| 4,203,412 | 5/1980 | Rickard | 124/23 R |
| 4,300,521 | 11/1981 | Schmitt | 124/23 R |
| 4,336,786 | 6/1982 | Mannon et al. | 124/23 R |
| 4,337,749 | 7/1982 | Barna | 124/24 R |
| 4,365,611 | 12/1982 | Nishioka | 124/24 R |
| 4,372,285 | 2/1983 | Simonds et al. | 124/90 |
| 4,440,142 | 4/1984 | Simonds | 124/23 R |
| 4,448,183 | 5/1984 | Quartino et al. | 124/24 R |
| 4,546,754 | 10/1985 | Smith | 124/86 |

*Primary Examiner*—Randolph A. Reese
*Assistant Examiner*—John A. Ricci
*Attorney, Agent, or Firm*—Wells, St. John & Roberts

[57] ABSTRACT

A compound bow employing an adjustable anchor for securing a tension cable to the bow is disclosed. The adjustable anchor preferably includes a body adapted for receiving a tension cable. A portion of the anchor is secured relative to the bow and slidably received relative to the body. An adjustment assembly is provided for selectively varying the position of the portion and body relative to one another for adjusting the tension in the tension cable.

30 Claims, 3 Drawing Sheets

COMPOUND BOW WITH ADJUSTABLE TENSION CABLE ANCHOR

TECHNICAL FIELD

This invention relates generally to archery bows, and more particularly to compound bows and tension cable anchors for compound bows.

BACKGROUND OF THE INVENTION

Compound archery bows have become increasingly popular for hunting and target shooting in recent years. These bows use tension cables which extend over eccentric pulleys revolvably mounted to the bow limbs to provide a mechanical advantage during the drawback and release of a bow string.

The compound bow cable includes a central, or bow string, portion for reception of the arrow. A pair of tension cable portions are connected to the ends of the bow string and extend over the eccentrically mounted pulleys. The tension cable portions typically cross one another between the limbs and attach to the bow limb opposite the pulley over which the respective tension cable portion extends. As the bow string is being drawn, the draw weight or force applied to the bow increases to a maximum draw weight and reduces to a lower draw weight at the full draw position due to the eccentric mounting of the pulleys. Accordingly, when the bow string is in the full dry position, maximum potential energy is stored in the bow while the force required to maintain the bow string in the full draw position is less than the maximum draw weight of the bow. In other words, maximum energy is stored in the limbs without requiring maximum force to be applied to the bow string to hold it at the full draw position. This permits the archer to maintain aim on his target prior to release for a longer time and without undue strain for producing a better shot.

Many devices have been developed for attaching the end of each tension cable to the bow. One such method simply attaches the ends of the tension cables directly to the bow limb by bolts. Other versions secure the inside cables to the bow limbs by means of a yoke member which in turn is secured by a yoke cable to the axle upon which the respective eccentric pulley is rotatably mounted. Anchoring devices such as these are shown in U.S. Pat. Nos. 4,546,754 to Smith; 4,440,142 to Simonds; 4,337,749 to Barna; 4,333,443 to Roelle; 4,300,521 to Schmidt; and 4,064,862 to Groner.

For example, the 4,440,142 patent to Simonds discloses a yoke cable connected at both its ends to a pulley axle which rotatably supports an eccentrically mounted pulley. The cable extends about a perimetric edge portion of a disk-like yoke for securing the disk relative to the axle. A plurality of attachment grooves are formed in the disk which are disposed at varying distances from the disk center. An end of the tension cable extends through the center of the disk and is received by any one of these attachment portions, and is looped back to itself and fixedly secured by a clasp or sleeve-like member. Such an anchoring device enables the tension in the tension cable to be adjusted by changing which of the attachment portions in which the loop in the tension cable is received.

Such a yoke structure is not without drawbacks. For example, to change the tension cable to a different attachment portion in the disk, tension in the cable must be released to enable the cable to be removed from the existing attachment portion. Additionally, each of the attachment portions is set at some fixed distance from the center which enables only a small number of specific finite tension adjustments to be made with a given disk.

Accordingly, a need remains for an improved compound bow having a tension cable anchor which overcomes the above-described drawbacks.

BRIEF DESCRIPTION OF THE DRAWINGS

Preferred embodiments of the invention are illustrated in the accompanying drawings, in which.

DETAILED DESCRIPTION OF A PREFERRED EMBODIMENT

The following disclosure of the invention is submitted in compliance with the constitutional purpose of the patent laws "to promote the progress of science and the useful arts" (Article 1, Section 8).

Figure 1:
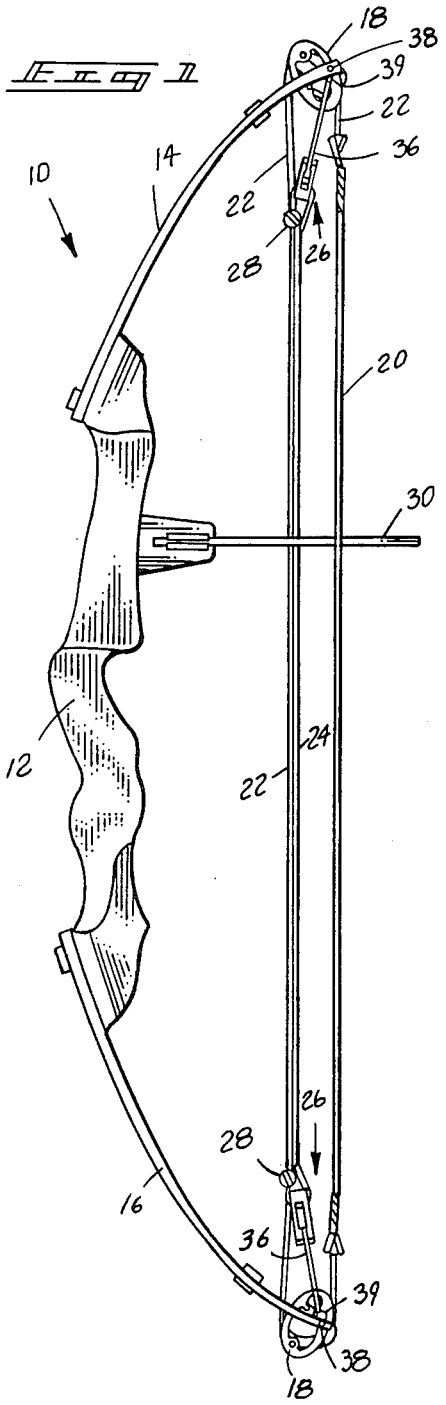
FIG. 1 is a side view of one embodiment of a compound bow employing a tension cable anchor in accordance with the invention.

Referring to FIG. 1, a compound bow 10 includes a center handle section 12 which supports upper and lower limbs 14, 16, respectively. Eccentric pulley assemblies 18 are rotatably mounted adjacent the outermost ends of upper and lower limbs 14, 16 by pulley axles 38. Bow 10 includes a central cable portion, or bow string 20, which is secured at both ends to a pair of tension cables 22, 24. Tension cables 22, 24 extend from the ends of bow string 20 over respective eccentric pulley assemblies 18 to the opposite bow limb where each is there secured by means of an adjustable anchoring assembly 26. The inside portions of the tension cables are held adjacent one another by means of button assemblies 28 which engage the tension cables adjacent anchoring assemblies 26 for keeping such cables collected and separated from bow string portion 20. A number of alternate assemblies such as springs etc., well-known in the art, could similarly be used in place of buttons 28. Compound bow 10 further includes a cable guard 30 which maintains collected tension cables 22, 24 slightly sideways further separating the cables from bow string 20. Adjustable cable anchoring assembly 26 is also of course usable without the inclusion of buttons 28 and cable guard 30.

Figure 2:
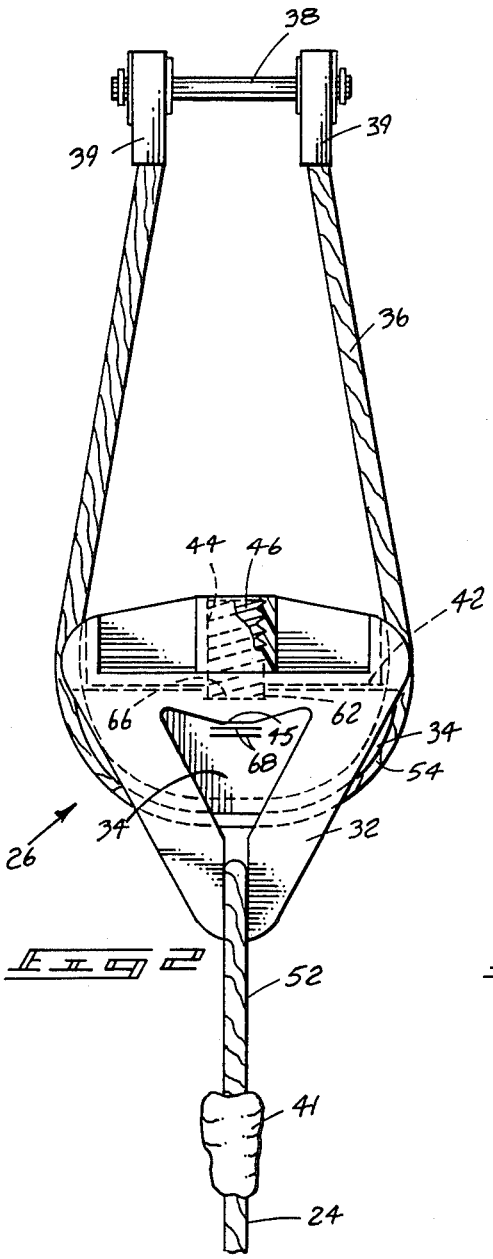
FIG. 2 is an enlarged front view of an adjustable tension cable anchor used in the compound bow shown in FIG. 1.

Referring to FIG. 2, one embodiment of a cable end anchor 26 in accordance with the invention is illustrated in the form of a yoke anchor. Anchor 26 includes a body 32 which movably receives a half disk-shaped yoke cable receiving member 34. Yoke cable receiving member 34 is adapted for receiving a yoke cable 36 about its outer perimetric edge 54. The ends of yoke cable 36 are anchored to pulley axle 38 by means of clasps or axle hangers 39.

Tension cable 24, as shown, is looped through the lower portion of body 32 and secured back to itself by swage clasps 41. Accordingly, anchor 26 serves to secure or anchor the end of tension cable 24 operably to the compound bow limb. Adjustment means are provided for selectively varying the position of yoke cable receiving member 34 and body 32 relative to one another for adjusting the tension in tension cable 24.

Figure 6:
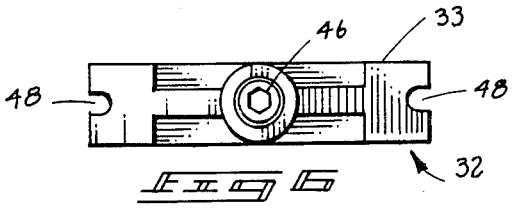
FIG. 6 is a top view of the body of FIG. 4.
Figure 4:
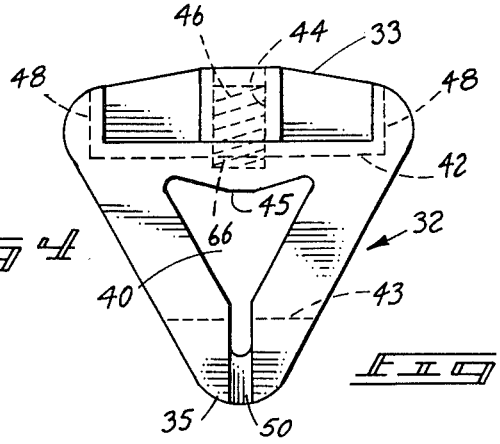
FIG. 4 is a front view of a body portion of the adjustable tension cable anchor of FIG. 2.
Figure 5:
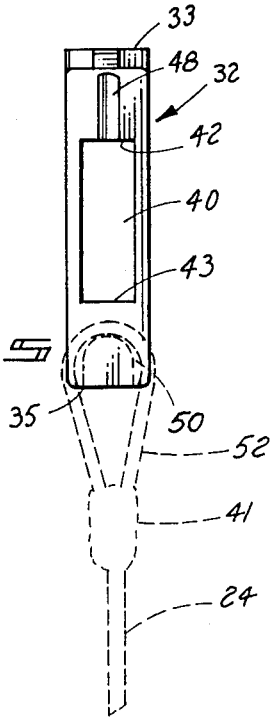
FIG. 5 is a side view of the body of FIG. 4.

Referring more particularly to FIGS. 4–6, body 32 is generally triangular in shape having first and second ends 33, 35 respectively, and a centrally disposed cavity 40. Cavity 40 is adapted for slidably receiving yoke cable receiving member 34 therein. The upper and lower-most extents of cavity 40 terminate in horizontal surfaces 42, 43 respectively. A threaded hole 44 is formed in first end 33 of body 32 and extends inwardly to upper surface 42. An adjustment element in the form of a set screw 46 is threadingly received by threaded hole 44 for engaging yoke cable receiving member 34 to enable its position within cavity 40 to be selectively varied, as will be more fully described below. Body 32 further includes a pair of opposing upper side edge grooves 48 extending from upper cavity surface 42 along outer side surfaces to first end 33 of body 32 for receiving yoke cable 36.

A grooved portion 50 is formed in the lower portion or second end 35 of body 32 and extends upwardly to central cavity 40. Groove 50 serves to receive an intermediate portion of tension cable 24 in the form of a loop 52 formed in the end of tension cable 24. Accordingly, groove 50 functions as a tension cable receiving means for enabling a tension cable to be secured to body 32.

Figure 9:
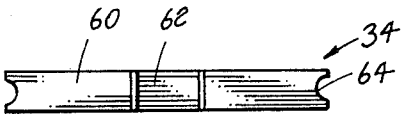
FIG. 9 is a top view of the yoke cable receiving member of FIG. 7.
Figure 7:
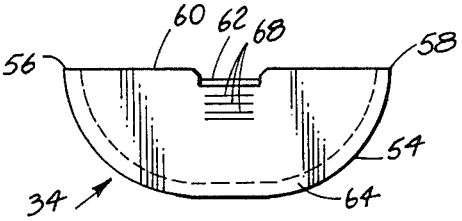
FIG. 7 is a front view of a yoke cable receiving member employed in the adjustable tension cable anchor of FIG. 2.
Figure 8:
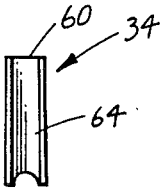
FIG. 8 is a side view of the yoke cable receiving member of FIG. 7.

Referring now to FIGS. 7–9, the yoke cable receiving member 34 is substantially semi-circular in shape having an arcuate first perimetric edge portion 54 terminating at two generally diametrically opposed locations 56, 58. Perimetric edge 54 includes a yoke cable receiving groove 64. A second perimetric edge portion 60 extends between diametrically opposed locations 56, 58. A recess 62 is formed in the center of second perimetric edge 60 and serves to receive set screw 46.

Figure 3:
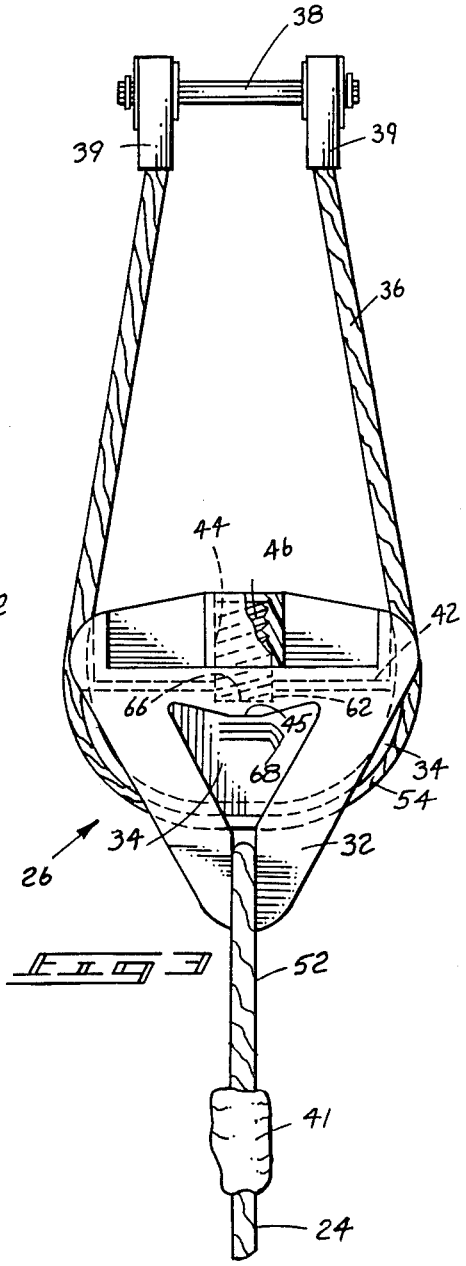
FIG. 3 is an enlarged front view of the adjustable tension cable anchor shown in an operative position displaced slightly from that shown in FIG. 2.

Referring to FIGS. 2 and 3, set screw 46 includes an innermost end 66 adapted to engage recess 62 of second perimetric edge 60 on yoke cable receiving member 34. When set screw 46 is threaded in counterclockwise fashion to be displaced away from central cavity 40, second perimetric edge 60 of yoke cable receiving member 34 will bear against upper cavity surface 42. By threading set screw 46 clockwise, moving the set screw towards cavity 40, the innermost end 66 of the set screw will bear against an inner surface in recess 62 of yoke cable receiving member 34 causing second perimetric edge 60 and surface 42 to be displaced from one another. The degree of displacement can be varied by the amount with which set screw 46 is inwardly threaded into opening 40 on body 32. Since yoke cable 36 is received about member 34 and tension cable 24 is received by body 32, such movement causes tension cable 24 to be moved with respect to the bow limb enabling its tension to be varied.

FIGS. 2 and 3 illustrate alternate positionings of body 32 and yoke cable receiving member 34 relative to one another providing different tensions in tension cable 24. The greater degree of inward threading of set screw 46, the greater will be the tension in the tension cable 24. Accordingly, the positioning in FIG. 3 provides greater tension in tension cable 24 than that in FIG. 2.

Indicia means can be provided for indicating the position of yoke cable receiving member 34 relative to body 32 to provide an indication of tension in cable 24. Such indicia means is shown in the form of a plurality of markings 68 formed in one or both of the opposing faces of yoke cable receiving member 34. Such markings align with a central straight surface 45 in body 32 to provide an indication of the position yoke cable receiving member 34 relative to body 32.

Such an anchoring structure has significant advantages over the prior art. For example, the set screw adjustment enables the tension in the tension cables to be adjusted on a compound bow without releasing the tension in such cables. Prior art devices generally require some form of tension release prior to adjusting tension. Additionally, the use of a set screw enables a nearly infinite number of tension adjustments to be made by merely varying the degree with which the set screw is turned.

Such features also provide significant advantages to manufacturers of compound bows. For example, one of the critical features in the manufacturing of compound bows is the tuning of the bows to assure that both the upper and lower eccentrically mounted pulley assemblies revolve through the over center point at precisely the same moment. A compound bow employing a pair of anchors in accordance with the invention will enable the bow assembler to rapidly produce this desired affect by making minor adjustments to either of the anchors as necessary without having to disassemble the bow.

Figure 11:
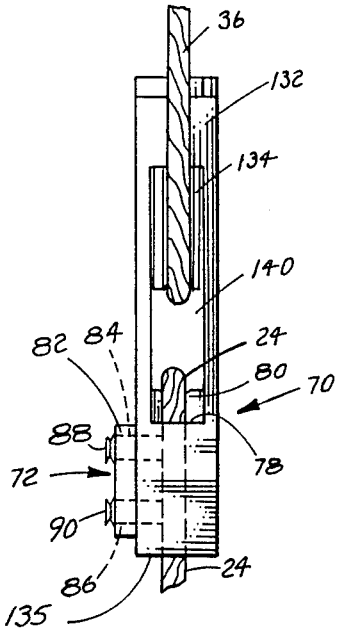
FIG. 11 is a side view of the adjustable anchor of FIG. 10.
Figure 10:
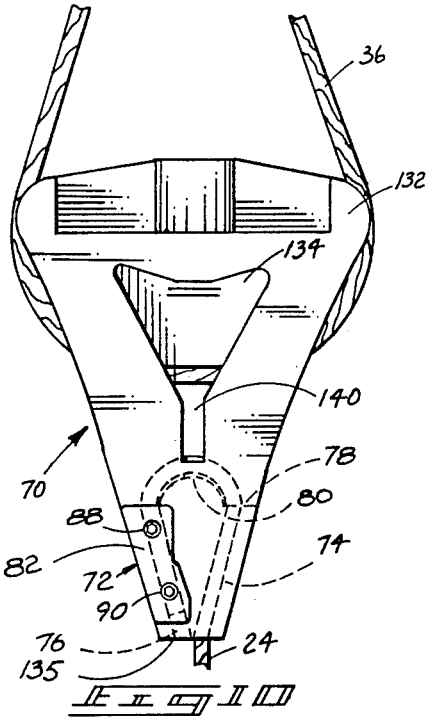
FIG. 10 is a front view of an alternate embodiment of an adjustable tension cable anchor in accordance with the invention.

An alternate embodiment of an adjustable anchor 70 in accordance with the invention is illustrated in FIGS. 10 and 11. Anchor 70 is similar to anchor 26 in that it is comprised of a yoke structure. Anchor 70 employs different tension cable receiving means than that employed by the body of yoke anchor 26. Anchor 70 includes a body 132 having a generally centrally disposed cavity 140 which receives a yoke cable receiving member 134. A clamping apparatus 72 is integrally formed as part of body 132 for securing a tension cable 24 to the anchor. Clamping apparatus 72 is preferably reusable and integrally formed in the body. Clamping apparatus 72 includes a pair of passageways 74, 76 which extend into the second end 135 of body 132 for receiving tension cable 24. Passageways 74, 76 diverge from one another towards centrally disposed cavity 140. An arcuate surface 78, integrally formed in body 132 and having a groove 80 formed therein, extends across the lower portion of cavity 140 between internal end openings of passageways 74, 76. An intermediate portion of tension cable 24 is adapted to be received across the surface 78 within groove 80.

Clamping apparatus 72 further comprises an upwardly projecting portion 82 formed adjacent second end 135 of body 132. Portion 82 is formed above passageway 76 but could just as well be formed above passageway 74. A pair of threaded holes 84, 86 extends from the exterior of body 132 through portion 82 to passageway 76. A pair of threaded elements or set screws 88, 90 are received in the respective threaded holes 84, 86 for clamping engagement against tension cable 24 while received in the passageways and engaged by arcuate surface 78 and groove 80. Set screws 88, 90 are movable between clamping and unclamping positions by being rotated in or out of threaded holes 84, 86 respectively. The clamping apparatus thereby provides a way for releasably and adjustably securing one end of a tension cable to anchor body 132.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received by said body; and adjustment means for selectively varying the position of the yoke cable receiving member and body relative to one another for adjusting the tension in the tension cable, the yoke cable receiving member being slidably, not threadably, received by said body, the yoke cable receiving member being slidable relative to the body between first and second extreme positions, the adjustment means enabling selective variation of the yoke cable receiving member relative to the body at any of a substantially infinite number of positions between the first and second extreme positions.

2. The yoke anchor of claim 1 including indicia means for indicating the position of the yoke cable receiving member relative to said body for indicating the tension in the tension cable.

3. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received by said body;

the body including a generally centrally disposed cavity, the yoke cable receiving member being received within the cavity; and adjustment means for selectively varying the position of the yoke cable receiving member and body relative to one another for adjusting the tension in the tension cable.

4. The yoke anchor of claim 3 wherein:

the yoke cable receiving member is generally semicircular in shape having an arcuate first perimetric edge portion terminating at two diametrically opposed locations, and a second perimetric edge portion extending between the two diametrically opposed locations;

a yoke cable receiving groove extending about the arcuate first perimetric edge portion between the two diametrically opposed locations; and the adjustment means comprising an adjustment element movably mounted on the body, the adjustment element engaging the second perimetric edge portion.

5. The yoke anchor of claim 4 wherein the adjustment element is in bearing relationship with respect to the second perimetric edge portion.

6. The yoke anchor of claim 4 wherein the second perimetric edge portion includes a recess, the adjustment element being received by said recess.

7. The yoke anchor of claim 4 wherein the adjustment element comprises a set screw threadingly received by the body.

8. The yoke anchor of claim 3 wherein the tension cable receiving means comprises a grooved portion formed in said body about which an intermediate section of a tension cable is adapted to be received, the grooved portion being exposed to the centrally disposed cavity.

9. A yoke anchor for a compound archery bow of the type having one end of a tension cable attached to the bow by means of a yoke cable, the yoke anchor comprising:

a body, the body being generally triangular in shape;

tension cable receiving means on said body for receiving a tension cable;

a yoke cable receiving member movably received by said body; and adjustment means for selectively varying the position of the yoke cable receiving member and body relative to one another for adjusting the tension in the tension cable.

10. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received by said body; and adjustment means for selectively varying the position of the yoke cable receiving member and body relative to one another for adjusting the tension in the tension cable, the adjustment means comprising a threaded hole formed in the body and a set screw received therein, the set screw engaging the yoke cable receiving member to selectively vary its position relative to the body.

11. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received by said body;

adjustment means for selectively varying the position of the yoke cable receiving member and body relative to one another for adjusting the tension in the tension cable;

the body including a generally centrally disposed cavity, the yoke cable receiving member being slidably received within the cavity; and the adjustment means comprising a threaded hole formed in the body which extends to the cavity, a set screw being received by the threaded hole for engaging the yoke cable receiving member to selectively vary its position within the cavity.

12. A yoke anchor for a compound archery bow of the type having one end of a tension cable attached to the bow by means of a yoke cable, the yoke anchor comprising:

a body;

tension cable receiving means on said body for receiving a tension cable, the tension cable receiving means including a grooved portion formed in said body about which an intermediate section of a tension cable is adapted to be received;

a yoke cable receiving member movably received by said body; and adjustment means for selectively varying the position of the yoke cable receiving member and body relative to one another for adjusting the tension in the tension cable.

13. A yoke anchor for a compound archery bow of the type having one end of a tension cable attached to the bow by means of a yoke cable, the yoke anchor comprising:

a body;

tension cable receiving means on said body for receiving a tension cable, the tension cable receiving means including a clamping apparatus;

a yoke cable receiving member movably received by said body; and adjustment means for selectively varying the position of the yoke cable receiving member and body relative to one another for adjusting the tension in the tension cable.

14. The yoke anchor of claim 13 wherein the clamping apparatus is integrally formed as part of the body, the clamping apparatus including at least one clamping element movable between clamping and unclamping positions.

15. The yoke anchor of claim 13 wherein the tension cable receiving means comprises a pair of passageways formed in the body adapted to receive a tension cable, and a surface extending between an opening of one of the passageways and an opening of the other of the passageways across which an intermediate section of a tension cable is adapted to be engaged; and the clamping apparatus comprising at least one threaded hole formed in the body, the hole being in communication with at least one of the passageways, and a threaded element received in the threaded hole for clamping engagement with a tension cable received in at least one passageway.

16. An anchor for securing a tension cable of a compound bow to the compound bow, comprising:

attachment means for securing the anchor to the compound bow;

tension cable receiving means for receiving a tension cable for its securing to the anchor, the tension cable receiving means and attachment means being slidably, not threadably, received relative to one another; and adjustment means for selectively varying the position of the attachment means and tension cable receiving means relative to one another for adjusting the tension in the tension cable, the adjustment means comprising a set screw which engages both the tension cable receiving means and the attachment means, threading of the set screw directly varying the relative positions of the tension cable receiving means and the attachment means.

17. An anchor for securing a tension cable of a compound bow to the compound bow, comprising:

attachment means for securing the anchor to the compound bow;

tension cable receiving means for receiving a tension cable for its securing to the anchor, the tension cable receiving means and attachment means being slidably received relative to one another;

adjustment means for selectively varying the position of the attachment means and tension cable receiving means relative to one another for adjusting the tension in the tension cable;

the attachment means comprising a yoke cable adapted for securing to the bow, and a yoke cable receiving member; and the adjustment means comprising a set screw threadably received by the tension cable receiving means, the threaded set screw bearing against the yoke cable receiving member.

18. The anchor of claim 17 wherein the tension cable receiving means includes a centrally disposed cavity, the yoke cable receiving member being slidably received in said cavity.

19. A compound archery bow comprising:

a center handle section supporting upper and lower limbs, at least one eccentrically mounted pulley attached to one of the handle section or limbs, a tension cable reeved about said one pulley and extending to a cable end anchor adjacent one of the handle section or limbs, said tension cable terminating in said cable end anchor;

said cable end anchor comprising:

attachment means for securing the anchor to the bow limb;

tension cable receiving means for receiving a tension cable for its securing to the anchor, the tension cable receiving means and attachment means being slidably, not threadably, received relative to one another;

adjustment means for selectively varying the position of the attachment means and tension cable receiving means relative to one another whereby the tension in said tension cable is adjustable;

the attachment means comprising a yoke cable, the ends of the yoke cable being secured to one of the bow limbs, and a yoke cable receiving member; and the adjustment means comprising a set screw threadably received by the tension cable receiving means, the threaded set screw bearing against the yoke cable receiving member.

20. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received internally within said body; and adjustment means for selectively varying the position of the yoke cable receiving member and body relative to one another for adjusting the tension in the tension cable.

21. An anchor for securing a tension cable of a compound bow to the compound bow, comprising:

attachment means for securing the anchor to the compound bow;

tension cable receiving means for receiving a tension cable for its securing to the anchor, the tension cable receiving means and attachment means being slidably received relative to one another;

adjustment means for selectively varying the position of the attachment means and tension cable receiving means relative to one another for adjusting the tension in the tension cable; and the adjustment means comprising:

a set screw which is threadingly received by the tension cable receiving means, the attachment means being engaged by the set screw.

22. A compound archery bow comprising:

a center handle section supporting upper and lower limbs, at least one eccentrically mounted pulley attached to one of the handle section or limbs, a tension cable reeved about said one pulley and extending to a cable end anchor adjacent one of the handle section or limbs, said tension cable terminating in said cable end anchor;

said cable end anchor comprising:

attachment means for securing the anchor to the bow limb;

tension cable receiving means for receiving a tension cable for its securing to the anchor, the tension cable receiving means and attachment means being slidably received relative to one another;

adjustment means for selectively varying the position of the attachment means and tension cable receiving means relative to one another whereby the tension in said tension cable is adjustable; and the adjustment means comprising:

a set screw which is threadingly received by the tension cable receiving means, the attachment means being engaged by the set screw.

23. A yoke anchor for a compound archery bow of the type having one end of a tension cable attached to the bow by means of a yoke cable, the yoke anchor comprising:

a body;

tension cable receiving means on said body for receiving a tension cable;

a yoke cable receiving member movably received by said body, the yoke cable receiving member being generally semi-circular in shape having an arcuate first perimetric edge portion terminating at two dimetrically opposed locations, and a second perimetric edge portion extending between the two diametrically opposed locations, a yoke cable receiving groove extending about the arcuate first perimetric edge portion between the two diametrically opposed locations; and adjustment means for selectively varying the position of the yoke cable receiving member and body relative to one another for adjusting the tension in the tension cable, the adjustment means comprising an adjustment element movably mounted on the body, the adjustment element engaging the second perimetric edge-portion.

24. The yoke anchor claim 23 wherein the adjustment element is in bearing relationship with respect to the second perimetric edge portion.

25. The yoke anchor of claim 23 wherein the adjustment element comprises a set screw threadingly received by the body.

26. A compound archery bow incorporating the yoke anchor of claim 1.

27. A compound archery bow incorporating the yoke anchor of claim 10.

28. A compound archery bow incorporating the anchor of claim 16.

29. A compound archery bow incorporating the yoke anchor of claim 20.

30. A compound archery bow incorporating the yoke anchor of claim 23.

* * * * *